US006142883A

United States Patent [19]

Ferrara

[11] Patent Number: 6,142,883

[45] Date of Patent: Nov. 7, 2000

[54] GOLF STANCE ALIGNMENT TRAINING DEVICE

[76] Inventor: Joseph Ferrara, Nine Field End La., Eastchester, N.Y. 10709

[21] Appl. No.: 09/179,220

[22] Filed: Oct. 27, 1998

Related U.S. Application Data

[63] Continuation-in-part of application No. 09/138,437, Aug. 21, 1998, abandoned.

[51] Int. Cl.[7] ..... A63B 69/36

[52] U.S. Cl. ..... 473/218; 473/272; 473/273

[58] Field of Search ..... 473/218, 272, 473/273

[56] References Cited

U.S. PATENT DOCUMENTS

| | | | |
|---|---|---|---|
| 3,166,327 | 1/1965 | Champion | 473/218 X |
| 3,229,981 | 1/1966 | Taber | 473/272 |
| 5,464,220 | 11/1995 | Hansen et al. | 473/218 |

*Primary Examiner*—George J. Marlo
*Attorney, Agent, or Firm*—Kilgannon & Steidl

[57] ABSTRACT

The golf alignment device of this invention is an adjustable frame, comprising a first side of said frame marked with indicia for positioning the forward foot of the golfer and being marked with indicia for placement of the rear foot according to the club to be used; a slotted second side of the frame extending from the end of the first side of the frame nearest the forward foot, which second side bears indicia for placement of the golf ball; a slotted third side extending from the other end of the first side; a fourth side joined to the ends of the second and third sides to form a frame; a first ball marker arm extending from the second side and within the frame, which arm is perpendicular to the second side and a pivotal second marker arm extending within the frame from the first side, the second marker arm being disposed such that an imaginary line extending from the center of its terminal end within the frame intersects a point just beyond the terminal end of the first marker arm situated within the frame.

10 Claims, 8 Drawing Sheets

GOLF STANCE ALIGNMENT TRAINING DEVICE

This application is a continuation-in-part of U.S. patent application Ser. No. 09/138,437, filed Aug. 21, 1998, now abandoned.

This invention refers and relates to a device that assists the golfer in memorizing during repeated practice sessions the proper alignment of golf ball and feet for different club heads relative to the target.

BACKGROUND OF THE INVENTION

In the game of golf, a golfer uses a series of clubs, each club having a differently angled club face. The distance of the ball from the target, the weather conditions and other ambient conditions dictate the choice of club for a particular shot. "Practice makes perfect" is a maxim to which all golf addicts adhere. It is believed that repeated practice swings leave a lasting memory with the golfer that allows the golfer to "lock in" proper foot alignment and ball placement relative to the target.

Among the parameters that govern the "sweet smell of success" in a golf swing is the correct alignment of golfer's feet for each of the different clubs. As used herein, "alignment" means the proper positioning of the front and rear foot and the golf ball relative to the target area. Foot alignment for a given club will vary from person to person. By using a stance alignment device during practice, the golfer will arrive at foot placement for each club that best suits the individual golfer's swing.

Prior art golf stance training devices include devices where the positioning of the feet is pre-set and the golf ball is positioned differently for each club head. See U.S. Pat. No. 4,538,815. Other golf stance alignment devices are shown in U.S. Pat. Nos. 4,322,084; 5,322,288; 5,363,060; 5,435,727; and 5,492,328.

It is an object of this invention to provide a new and improved practice device for the proper alignment of the golf ball and the golfer's feet relative to the target area for the entire gamut of club heads.

It is another object of this invention to provide a panel having visual indicia for the alignment of the golfer's feet and the golf ball relative to the target, which panel may be used by a right or left handed golfer.

It is a further object of this invention to provide a golf alignment device which can be used with a variety of different size and types of golf clubs.

It is another object of this invention to provide a golf alignment device which is safe to use and will not interfere with the ball or club when the ball is being hit.

It is still another object of this invention to provide a golf alignment device which can be personally calibrated by the golfer It is yet still another object of this invention to provide a golf alignment device which is easy to assemble and use.

SUMMARY OF THE INVENTION

The golf alignment device of this invention is an adjustable rectangular frame, comprising a first side of said frame being marked with indicia for positioning the forward foot of the golfer and being marked with indicia for placement of the rear foot according to the club to be used; a slotted second side of the frame extending perpendicularly from the end of the first side of the frame nearest the forward foot, which second side bears indicia for placement of the golf ball; a slotted third side extending perpendicularly from the other end of the first side; a fourth side parallel to the first side and joined to the ends of the second and third sides to form a rectangular frame; a first ball marker arm extending from the second side and within the frame, which arm is perpendicular to the second side and a second marker arm extending within the frame perpendicular to the first side, the second marker arm being disposed such that an imaginary line extending from the center of its terminal end within the frame intersects a point just beyond the terminal end of the first marker arm situated within the frame. The first marker arm serves the function of directing the placement of the tee for the driver club, the tee being placed at the terminal end of the first marker arm within the frame. Disposing the second marker arm in the manner described herein provides a sight line for the placement of the golf ball for each of the different golf clubs, the ball being placed along the sight line and across from a club size indicia disposed on the second side of the frame. Disposing the indicia for golf ball placement on the second side of the frame and the indicia for rear foot placement on the first side of the frame is usually made after a "cut and try" experimenting by the golfer. Thus, the golf alignment device of this invention is tailored to the individual golfer.

To accommodate golfers of different height and the personal preference of the individual golfer, the first side of the rectangular frame may be moved toward or away from the fourth side of the rectangular frame by adjusting the first side along the slotted second and third sides of the rectangular frame.

In a preferred embodiment of the device of this invention a structure for hooking the device of this invention to the mat at the golf driving range is provided.

BRIEF DESCRIPTION OF THE DRAWINGS

In the drawings wherein like reference numerals represent like parts.

DETAILED DESCRIPTION OF PREFERRED EMBODIMENTS

Figure 1:
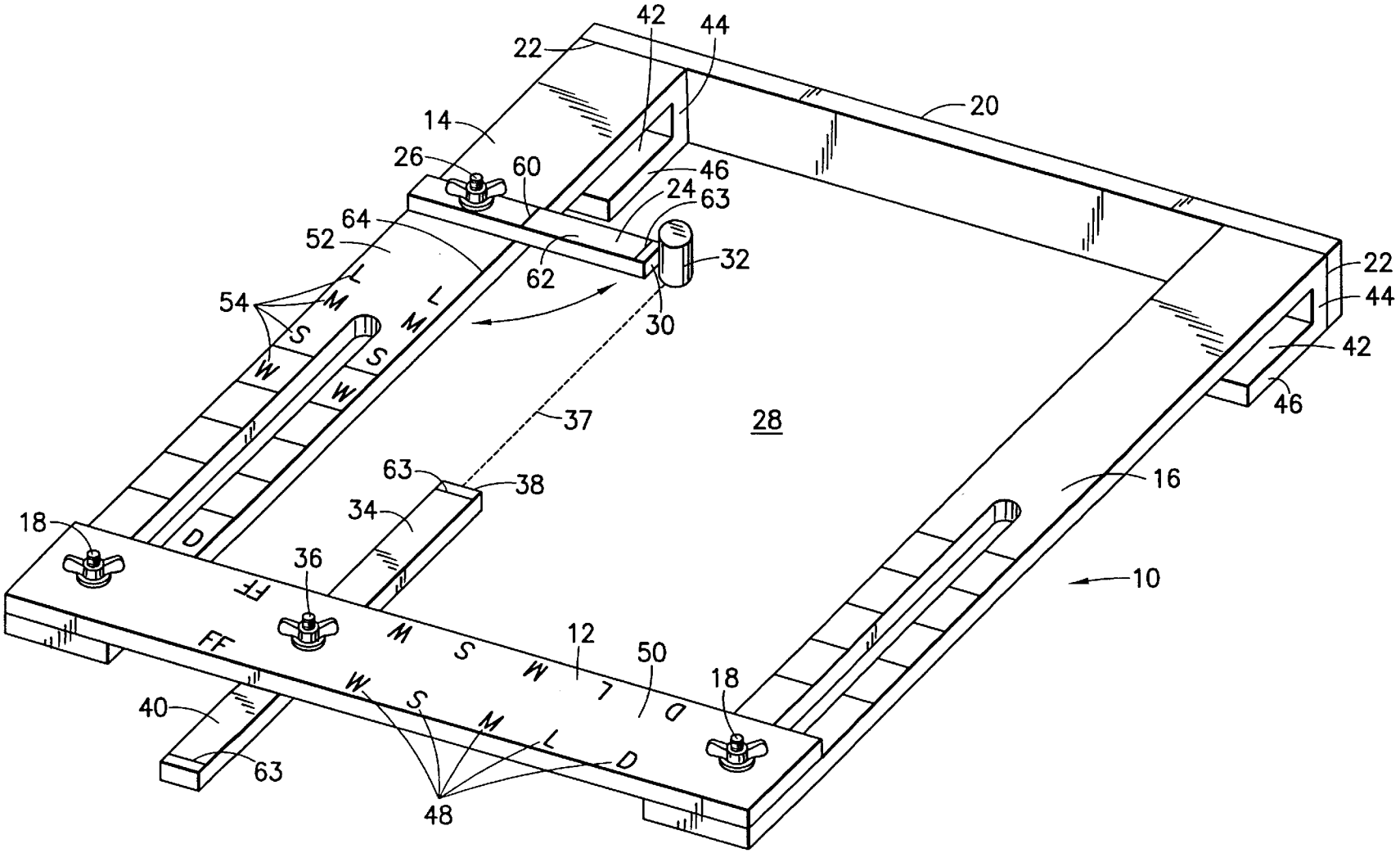
FIG. 1 is a perspective view of the golf alignment device of this invention.
Figure 2:
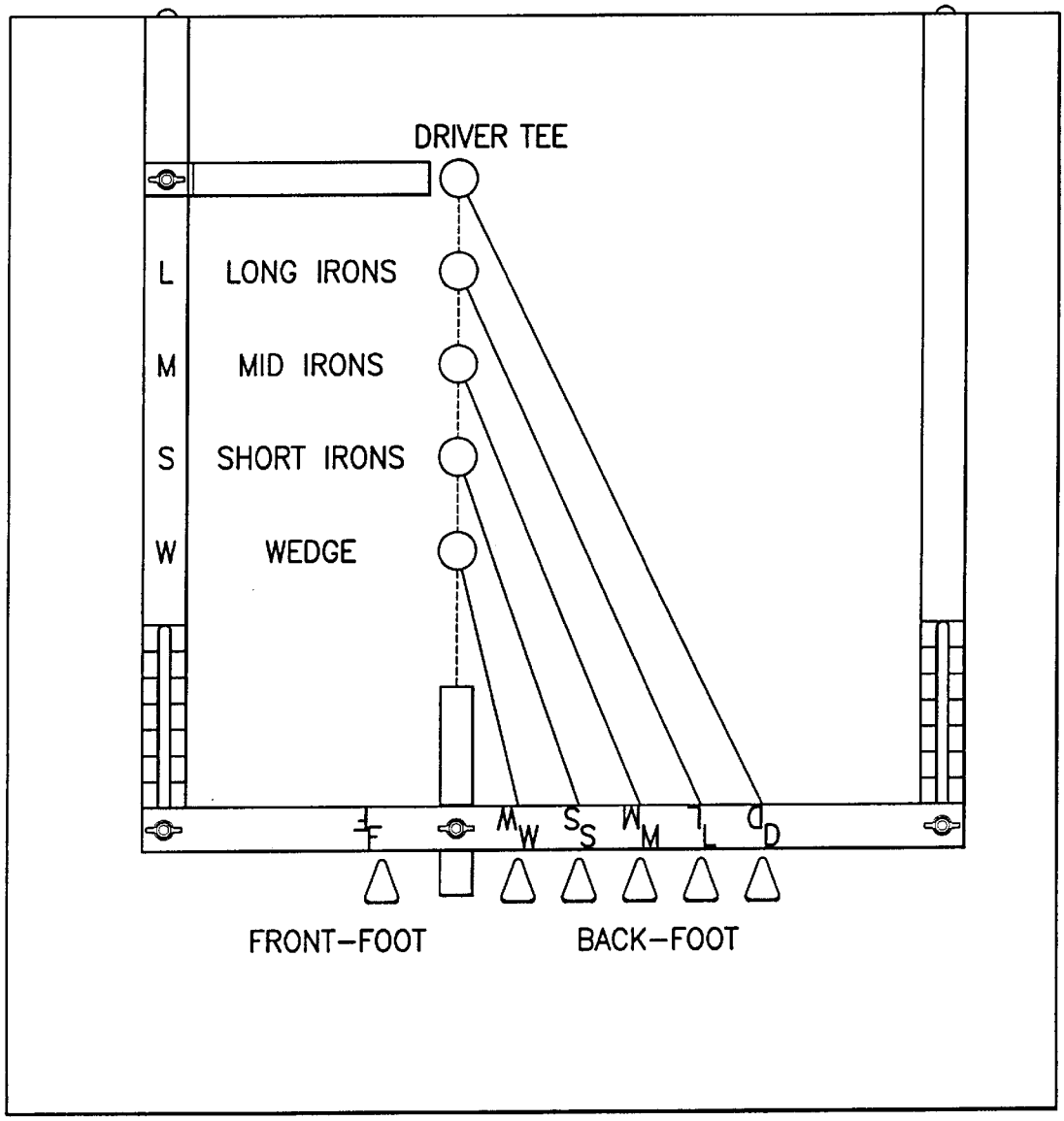
FIG. 2 is a map of a possible arrangement of a golf ball and golfer's feet for different golf clubs.

Referring now to the drawings, there is shown in FIG. 1 a rectangularly-shaped golf alignment training device according to the present invention and identified generally 10. For illustrative purposes, the golf alignment training device 10 as shown in FIG. 1 is assembled for use by a right hand golfer.

Golf alignment training device 10 includes a foot positioning first side 12. Secured at each end of the first side 12 and extending perpendicular therefrom are second side 14 and third side 16, the second side 14 and third side 16 being slotted. As shown in FIG. 1, the first side 12 is secured to the second and third sides, 14 and 16, respectively, through a bolt, washer and wing nut assembly 18 which allows for rapid adjustment of the first side 12 along the sides 14 and 16. The fourth side 20 is secured to the ends 22 of the second side 14 and the third side 16 by, for example, a bolt, washer and wing nut assembly (not shown).

A first marker arm 24 is secured to the second side 14 through a bolt, washer and wing nut assembly 26, the marker arm 24 extending perpendicularly to second side 14 and within the rectangle 28 defined by the four sides 12, 14, 16 and 20. The first marker arm 24 has a terminal end 30. A golf tee 32 is positioned contiguous to the terminal end 30 of the first marker arm 24. A marking 60 is provided on the top surface 62 of the first marker arm 24, which marking 60 should be parallel to the edge 64 of the first marker arm 24, thereby assuring that the first marker arm 24 is perpendicular to the second side 14. A second marker arm 34 is secured to the first side 12 through a bolt and wing nut assembly 36, the second marker arm 34 extending within the rectangle 28 and perpendicular to the first side 12, such that an imaginary line (shown in dash line sequence 37) extending from the center of the terminal end 38 intersects the tee 32. Further, the second marker arm 34 has a rearward portion 40 extending beyond the first side 12.

Figure 5:
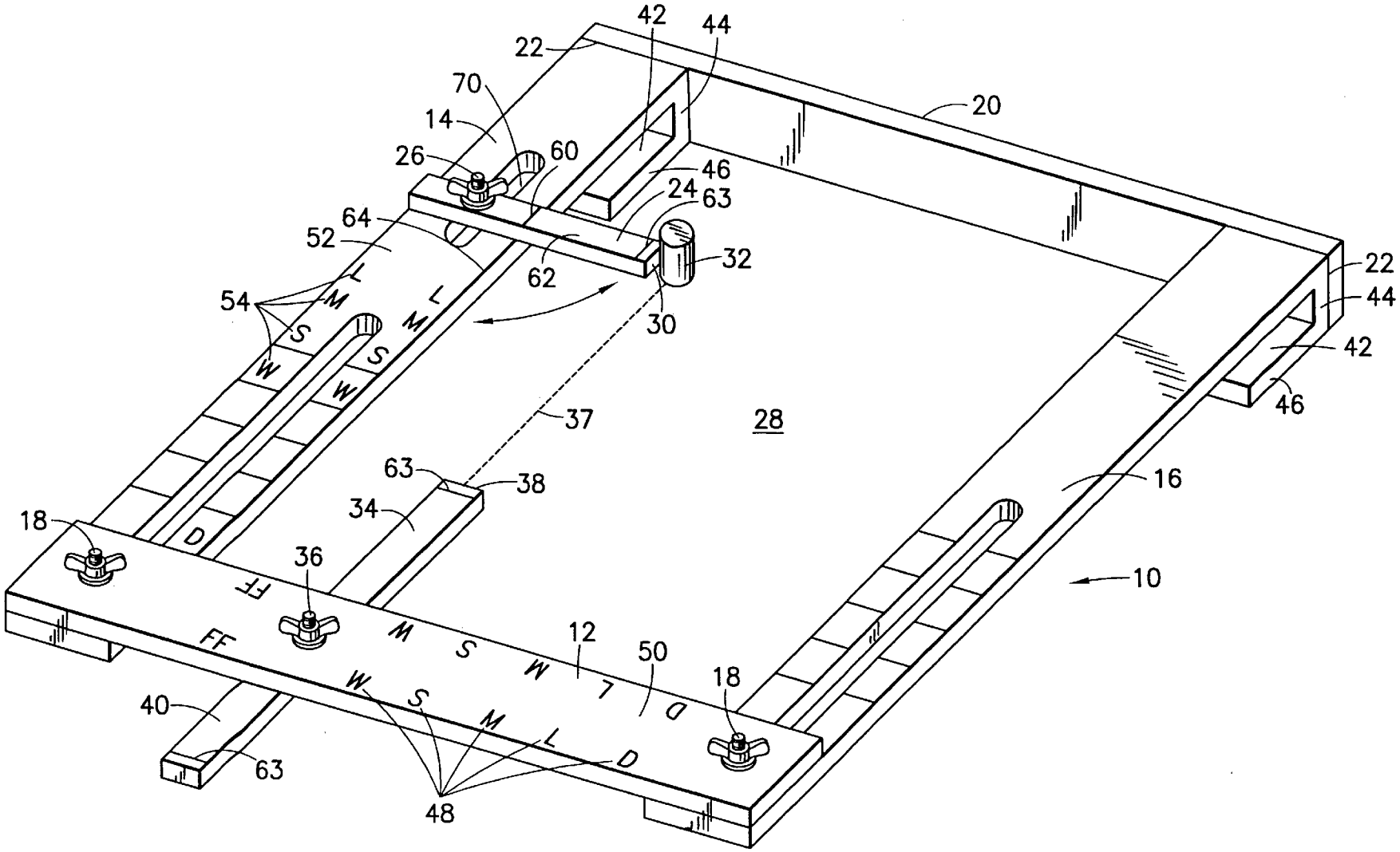
FIG. 5 is a perspective view of a further embodiment of the golf alignment device of this invention.

As shown in FIG. 5, the first marker arm 24 may be attached to the second side 14 within the slot 70 to allow for adjusting the position of the first marker arm 24. The parts in FIG. 5 correspond to the numbered parts shown in FIG. 1.

Beneath the second side 14 and the third side 16 is a structure attaching the device 10 to a mat (not shown) at the driving range, which structure comprises a slot 42 formed by a leg 44 perpendicular to and projecting from the underside of the terminal end 22 of each of second side 14 and third side 16 and a leg 46 extending perpendicular to the leg 44 and a short distance along each of the second side and the third side; the slot 42 may be drawn over the edge of a mat at the driving range.

Figure 6:
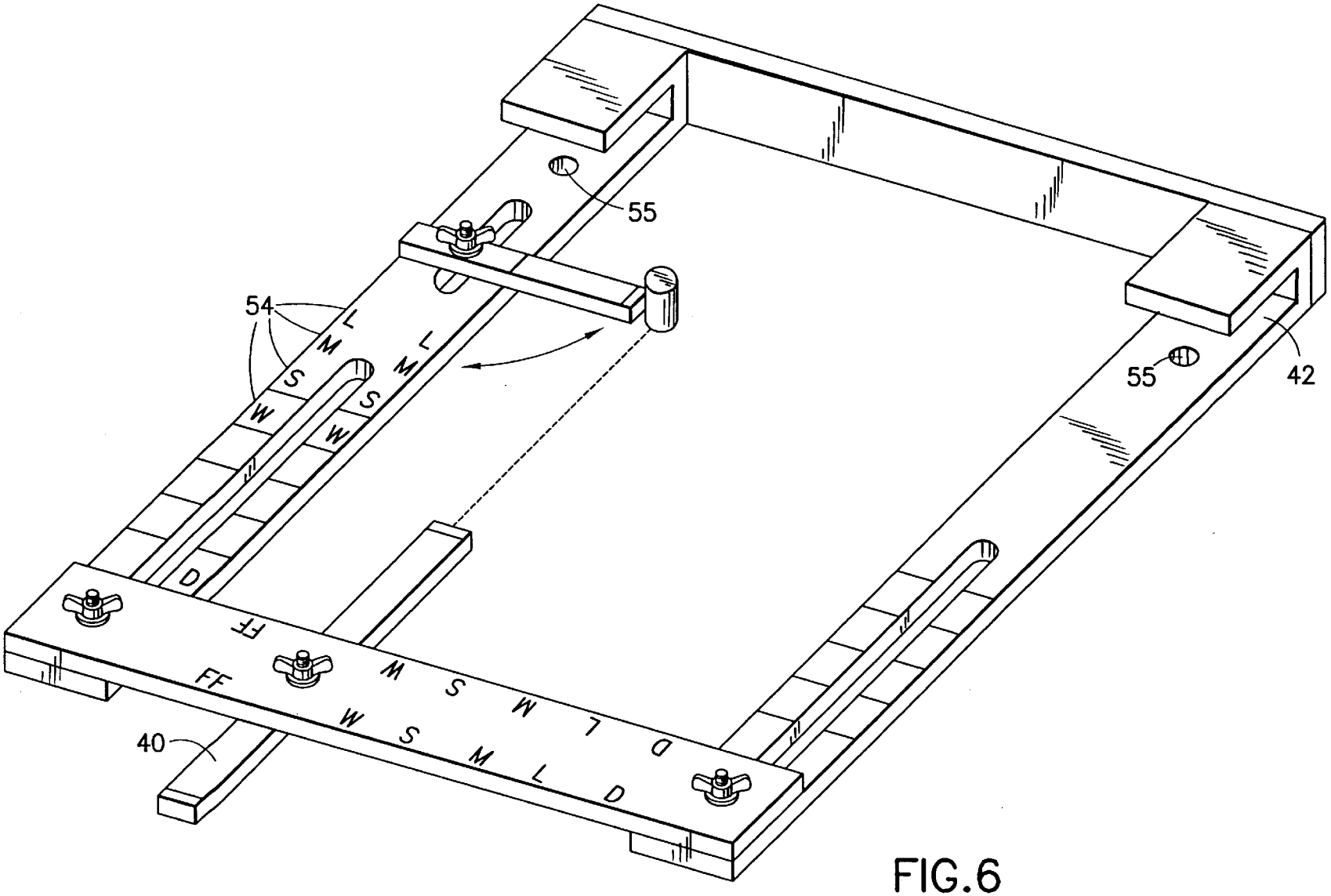
FIG. 6 is a perspective view of a further embodiment of the golf alignment device of this invention.

As best shown in FIG. 6, where the golf alignment device of this invention is to be used on a grass or dirt surface, the slot 42 may be inverted by inverting the sides 14 and 16. Indicia 54 may also be disposed on the reverse side of side 14. Additionally, holes 55 are provided for insertion of tees (not shown) or other objects to hold the device of this invention in place on the grass or dirt surface.

Also, as shown in FIG. 1, the forward foot (FF) of a right-handed golfer is placed on the left side of the rearward portion 40 of the first marker arm 34. On the right side of the rearward portion 40 of the first marker arm 34 and on the top surface 50 of the first side 12, indicia 48, is displayed for placement of the golfer's rear foot according to the golf club being used. For example, and as shown in FIG. 1, the indicia W. S, M. L and D represent rear foot placement for the wedge (w), short irons (S), medium irons (M), long irons (L) and the driver (D). On the top surface 52 of the second side 14, indicia 54 is placed to show the distance from the tee 32, a golf ball is placed on the imaginary line 37 for the indicated clubs, i.e., long irons (L), medium irons (M), short irons (S) and wedge (W). As a visual aid to the placement of the forward foot and the golf ball, a distinguishing color line 63 is placed near the terminal end 30 of the first marker arm 24 and near each terminal end of the second marker arm 34.

As noted earlier, the placement of the indicia may await one or more practice sessions with each club size to determine where the indicia is best placed to obtain the optimum performance for the individual user of the device. Further, the indicia for the placement of the feet for a plurality of individual golfers may be disposed on the first side 12 by placing a row of indicia offset from the first row. Also, as shown in FIG. 1, indicia 48 for a left-handed golfer may be provided on the first side 12.

When practicing with the driver, the bolt and wing nut assembly 26 may be loosened and the first marker arm 24 folded onto the top surface 52 of the second side 14.

The rectangular frame of this invention may be assembled for a right-handed or left-handed player. To assemble for a left-handed golfer, exchange the positions of second side 14 with its marker arm 24 and the third side 16 and turn the first side 12 with its second marker arm 34 one hundred eighty (180°) degrees. Note the FF, W, S, M, L and D markings 48 on opposite edges of the top surface 50 of the first side 12. When the first side 12 is rotated 180°, the indicia 48 will appear as in FIG. 1, and the second marker arm 24 will move to the right of the position shown in FIG. 1, but set for use by a left-handed golfer.

Figure 7:
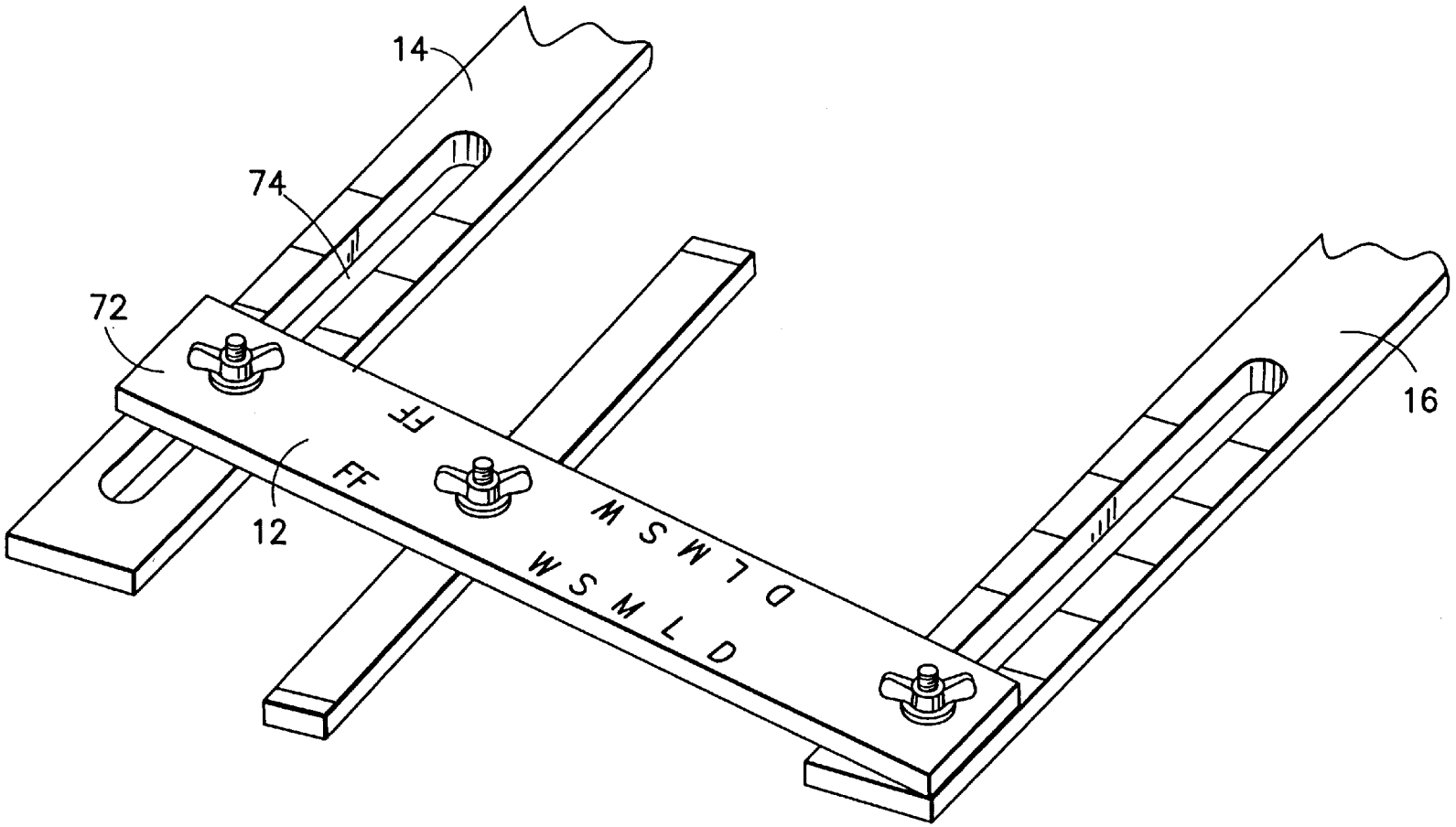
FIGS. 7 and 8 are partial perspective views of the golf alignment device of this invention illustrating the adjustment of the device for an open and closed stance of a right-handed golfer.
Figure 8:
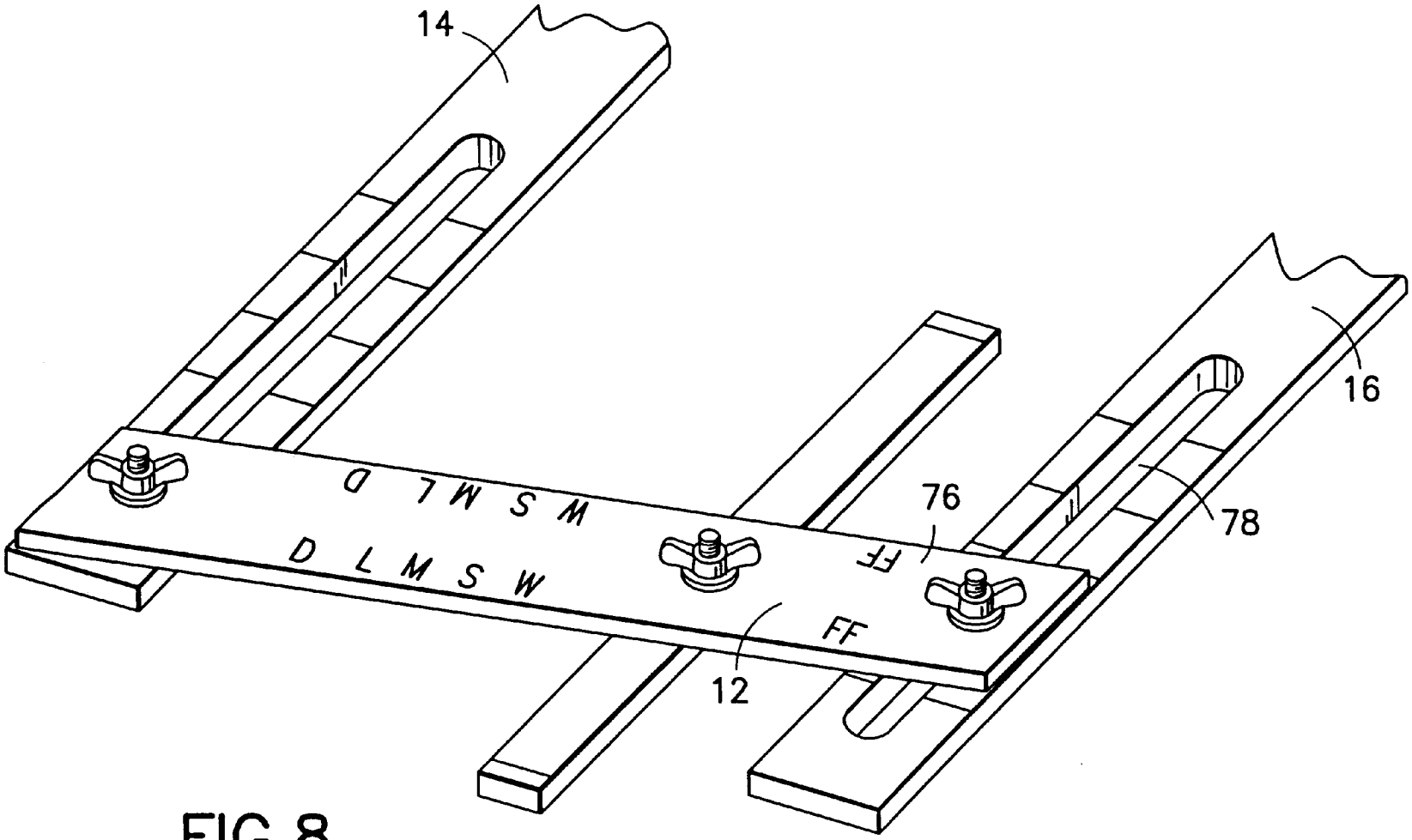

FIG. 7 illustrates how the device of this invention may be altered to provide a closed stance for a right-handed golfer. As shown, by moving the end 72 of the first side 12 forward in the slot 74 results in placing the left foot of the right-handed golfer to forward of the rear foot, the so-called "closed" stance. FIG. 8 illustrates how the device of this invention may be altered to provide an open stance for a right-handed golfer. As shown, by moving the end 74 of the third side 16 forward in the slot 78 results in placing the right foot of the right-handed golfer forward of the rear foot, the so-called "open" stance.

By following the procedure discussed above for assembling the rectangular frame of this invention for a left-handed golfer, the "open" and "closed" stance for a right-handed golfer shown in FIGS. 7 and 8 may be converted to the corresponding "open" and "closed" stance for a left-handed golfer.

The benefit to be gained by the golfer's use of the device of this invention is that repeated use will assist the brain in memorizing the proper foot alignment relative the position of the ball and the target sought for each of the clubs used.

Figure 3:
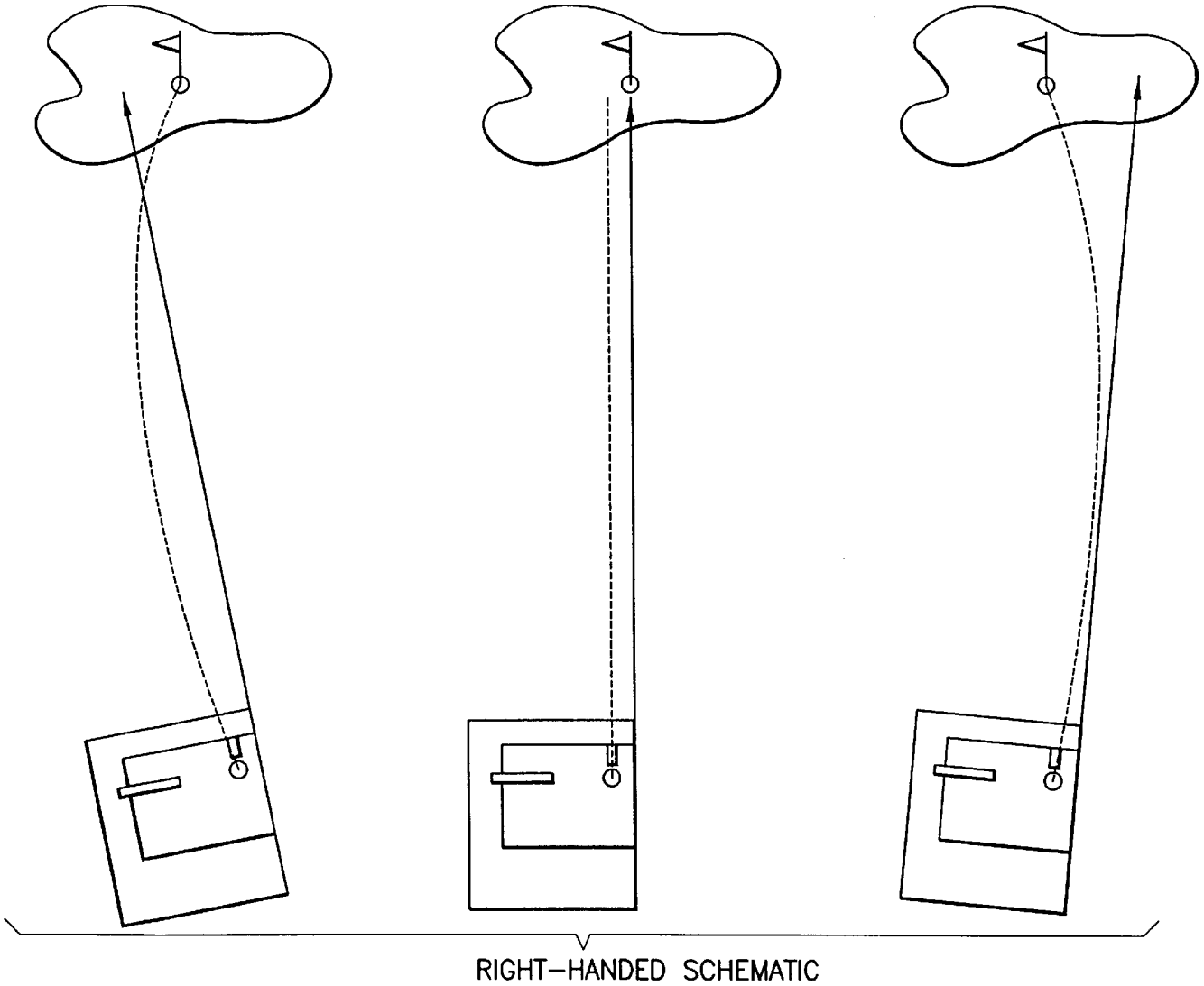
FIG. 3 is a schematic showing the positioning of the device of this invention for right-handed golfer whose shot normally fades, or draws or is straight.
Figure 4:
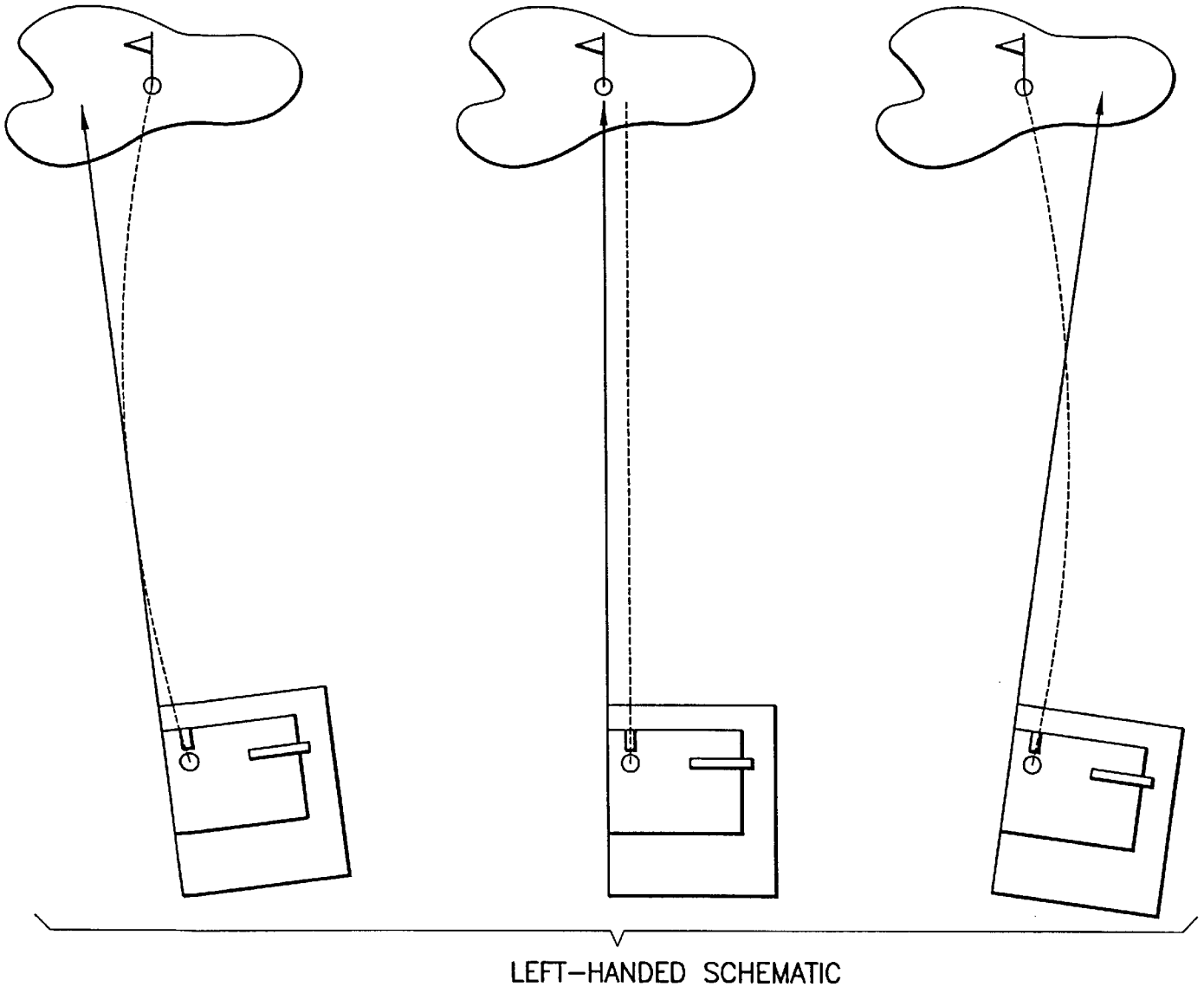
FIG. 4 is a schematic showing the positioning of the device of this invention for left-handed golfer whose shot normally fades, or draws or is straight.

FIG. 3 is a schematic drawing showing a possible placement of the device of this invention on a practice mat for a right-handed golfer, depending on whether the golfer naturally hits a fade, straight or draw shot. FIG. 4 shows a similar schematic for a left-handed golfer.

The device of this invention may be simply and easily assembled. The materials are:

four (4) frame bars;

two (2) alignment bars;

six (6) bolts with star washers and wing nuts (six bolts ¼ inch by ½ inch long);

two (2) large rubber washers (1½ inch);

two (2) small rubber washers (¾ inch);

twenty-two (22) letters (2 F, 4 W, 4 S, 4 M, 4 L, 4 D);

Instructions for assembly:

Bar 1 attaches to Bars 3 using two bolts, two star washers and two wingnuts.

Bar 2 attaches to Bars 5 using two bolts, two large rubber washers 1½ inch, two star washers and two wingnuts.

Bar 3 attaches to Bar 2 underneath using one bolt, one small rubber washer ¾ inch, one star washer and one wingnut.

Bar 4 attaches to Bar 5 on top, using one bolt, one small rubber washer ¾ inch, one star washer and one wingnut.

Although specific examples of the invention have been shown for purposes of disclosure, it is to be understood that various modifications can be made therefrom without departing from the spirit and scope of the invention.

I claim:

1. A golf training device comprising an enclosed frame having a first side for placement of the golfer's feet contiguous thereto, slotted second and third sides secured thereto and extending from opposite ends of the first side, the position of the first side relative to the second and third sides being adjustable by movement of the first side along the length of the slotted second and third sides, a fourth side secured to the second and third sides so as to define together with the first, second and third sides an enclosed frame; said frame having disposed thereon a first marker arm extending a distance within the enclosed frame and being disposed perpendicular to the second side of the enclosed frame and, further, said enclosed frame having a second marker arm adjustably disposed on the first side of the enclosed frame and extending within and beyond the enclosed frame, said second marker arm being alignable with the first marker arm such that an imaginary line from the terminal end of the second marker arm extends through a point contiguous to the terminal edge of the first marker disposed within the frame.

2. The golf alignment training device of claim 1, and further wherein indicia for foot placement are disposed on the first side, the forward foot indicia being disposed on one side of the second marker arm and contiguous thereto, and the rear foot indicia for each club being disposed on the other side of the second marker in the sequence of decreasing club face angle to the shaft of the club as the respective indicia is disposed away from the second marker arm.

3. The golf alignment training device of claim 2, and further wherein indicia for golf ball placement are disposed on the second side between the first marker arm and the first side in such sequence that the golf ball placement indicia for the club head with the smallest club head angle to golf club shaft is disposed nearest to the first marker arm.

4. The golf alignment training device according to any of claims 1, 2 or 3, wherein said device is provided with means for positionally anchoring the training device to a driving range mat.

5. The golf alignment training device according to any of claims 1, 2 or 3, and further wherein the first marker arm is mounted to the second side such that the first marker arm may be pivotably moved from within the rectangular frame.

6. The golf alignment training device according to claim 5, and further wherein the first marker arm bears a visible marking that denotes that the first marker arm extends perpendicular to the second side.

7. The golf alignment training device of claim 6, wherein the visible marking is a marking on the upper surface of the first marker arm that aligns with the inner or outer longitudinal edge of the second side.

8. The golf alignment training device of claim 1, and further wherein the second marker arm is adjustably positioned on the second side.

9. The golf alignment training device of claim 8, wherein the second marker arm is positioned within an elongated slot in the second side.

10. The golf alignment training device of claim 1, and further wherein the second and third sides have openings to receive a means for anchoring the training device to the surface on which the device is disposed.

* * * * *